US009669366B2

(12) United States Patent
Reif et al.

(10) Patent No.: US 9,669,366 B2
(45) Date of Patent: Jun. 6, 2017

(54) MIXING SYSTEM

(75) Inventors: Oscar-Werner Reif, Hanover (DE); Gerhard Greller, Goettingen (DE); Juergen Van Den Boogaard, Dransfeld (DE); Karl-Heinz Kompart, Bodenfelde (DE); Marco Lohrengel, Hattorf am Harz (DE)

(73) Assignee: SARTORIUS STEDIM BIOTECH GMBH, Goettingen (DE)

( * ) Notice: Subject to any disclaimer, the term of this patent is extended or adjusted under 35 U.S.C. 154(b) by 933 days.

(21) Appl. No.: 12/991,466

(22) PCT Filed: May 7, 2009

(86) PCT No.: PCT/EP2009/003253

§ 371 (c)(1),
(2), (4) Date: Nov. 8, 2010

(87) PCT Pub. No.: WO2009/143955

PCT Pub. Date: Dec. 3, 2009

(65) Prior Publication Data

US 2011/0058448 A1 Mar. 10, 2011

(30) Foreign Application Priority Data

May 28, 2008 (DE) ..... 10 2008 025 507

(51) Int. Cl.

| | |
|---|---|
| ***B01F 7/16*** | (2006.01) |
| ***B01F 11/00*** | (2006.01) |
| ***B01F 13/04*** | (2006.01) |
| ***B01F 15/00*** | (2006.01) |

(52) U.S. Cl.
CPC ..... *B01F 7/16* (2013.01); *B01F 11/0082* (2013.01); *B01F 13/045* (2013.01); *B01F 15/00071* (2013.01); *B01F 15/0085* (2013.01); *B01F 15/00831* (2013.01)

(58) Field of Classification Search
CPC ..... B01F 7/16
USPC ..... 366/279, 331, 332
See application file for complete search history.

(56) References Cited

U.S. PATENT DOCUMENTS

| | | | | |
|---|---|---|---|---|
| 5,100,241 | A * | 3/1992 | Chan | 366/139 |
| 2002/0145940 | A1* | 10/2002 | Terentiev | 366/273 |
| 2003/0008389 | A1* | 1/2003 | Carll | 435/302.1 |
| 2005/0002274 | A1* | 1/2005 | Terentiev | 366/273 |
| 2005/0239199 | A1 | 10/2005 | Kunas et al. | |
| 2005/0249033 | A1 | 11/2005 | Krause | |

(Continued)

FOREIGN PATENT DOCUMENTS

| | | |
|---|---|---|
| DE | 20 2007 005 868 | 8/2007 |
| DE | 10 2006 022 651 | 10/2007 |
| EP | 0 210 651 | 2/1987 |

(Continued)

*Primary Examiner* — David Sorkin
(74) *Attorney, Agent, or Firm* — Gerald E. Hespos; Michael J. Porco; Matthew T. Hespos

(57) ABSTRACT

A mixing system has a single-use container (1) with flexible walls and a mixing device. The mixing device has at least one encapsulated drive (5) and a mixer shaft (3). The drive (5) can be disposed of after use together with the mixer shaft (3) and the single-use container (1). The mixing system can be used in biotechnology and the pharmaceutical industry for mixing liquids, dissolving solids or cultivating cells and microorganisms.

9 Claims, 3 Drawing Sheets

(56) References Cited

U.S. PATENT DOCUMENTS

| | | | |
|---|---|---|---|
| 2006/0280028 | A1 | 12/2006 | West et al. |
| 2007/0053238 | A1 | 3/2007 | Kocienski |

FOREIGN PATENT DOCUMENTS

| | | |
|---|---|---|
| WO | 2005/118771 | 12/2005 |
| WO | 2008/101124 | 8/2008 |

* cited by examiner

MIXING SYSTEM

BACKGROUND OF THE INVENTION

1. Field of the Invention

The invention relates to a mixing system with a single-use container with flexible walls and a mixing device for single use, in particular for mixing sterile media or cell cultures.

2. Description of the Related Art

Single-use containers with flexible walls are increasingly used in biotechnology and in the pharmaceutical industry for mixing liquids, dissolving solids in liquids or cultivating cells and microorganisms. Here, an advantage of single-use containers made of plastic is that they can already be supplied by the supplier in a clean and sterile state, as a result of which complex cleaning procedures and validations pre-use are dispensed with.

Rotating mixer shafts, provided with mixer elements such as propellers, or vibration mixers, in which a perforated mixer plate is subjected to a linear up and down motion, are particularly suitable for effective mixing of media in single-use containers with flexible walls for single use.

In this context, one of the largest problems consists of coupling a generally unsterile drive to the sterile mixer shaft in the container interior whilst maintaining sterility. In a frequently used solution—the magnetic stirrer—the mixing element is for this purpose equipped with permanent magnets, which are driven by a rotating magnetic field. Another option consists of guiding a mixer shaft, which is mechanically coupled to a drive, through the container wall, with the through-hole in the container inner wall needing to be sealed against the passage of contaminants in a complicated fashion.

The object of the invention therefore is to provide a mixing system, in which the drive does not have a negative influence on the sterility of the container interior of the single-use container.

According to the invention, the object is achieved by a mixing system with a drive, which is encapsulated and which can be disposed of after use together with the mixer shaft and the single-use container.

SUMMARY OF THE INVENTION

The invention comprises a mixing system assembled from a single-use container with flexible walls for single use and a mixing device, the mixing device having at least one encapsulated drive that can be disposed of after use together with the mixer shaft and the single-use container. The encapsulation is preferably implemented by embedding the drive in plastic. This prevents the ingression of particles and other contaminants. The outlet of the mixer shaft from the encapsulation is preferably sealed by a seal. In the process, seals made of plastic, preferably lip seals or molded-on multi-component injection-molded seals, are preferred. Such seals are impenetrable for gasses, liquids and microorganisms. The drive can be situated both outside of the container interior and within the container interior. Here, the invention relates to embodiments with drives in which the mixer shaft is set either into rotation or into a linear up and down motion. The drive can be both an electric motor and a drive operated by pneumatics or hydraulics. A pneumatic or hydraulic drive is particularly advantageous because it can be produced exclusively from plastics, which is advantageous for an environmentally friendly disposal. In a particular embodiment, the motor was sterilized prior to installation by a treatment with electromagnetic radiation, by autoclaving or by sterilizing media acting thereon. In a particular embodiment, the mixing system for mixing media can be used as a bioreactor.

The invention will be explained in more detail by the following figures.

DETAILED DESCRIPTION OF THE PREFERRED EMBODIMENTS

Figure 1:
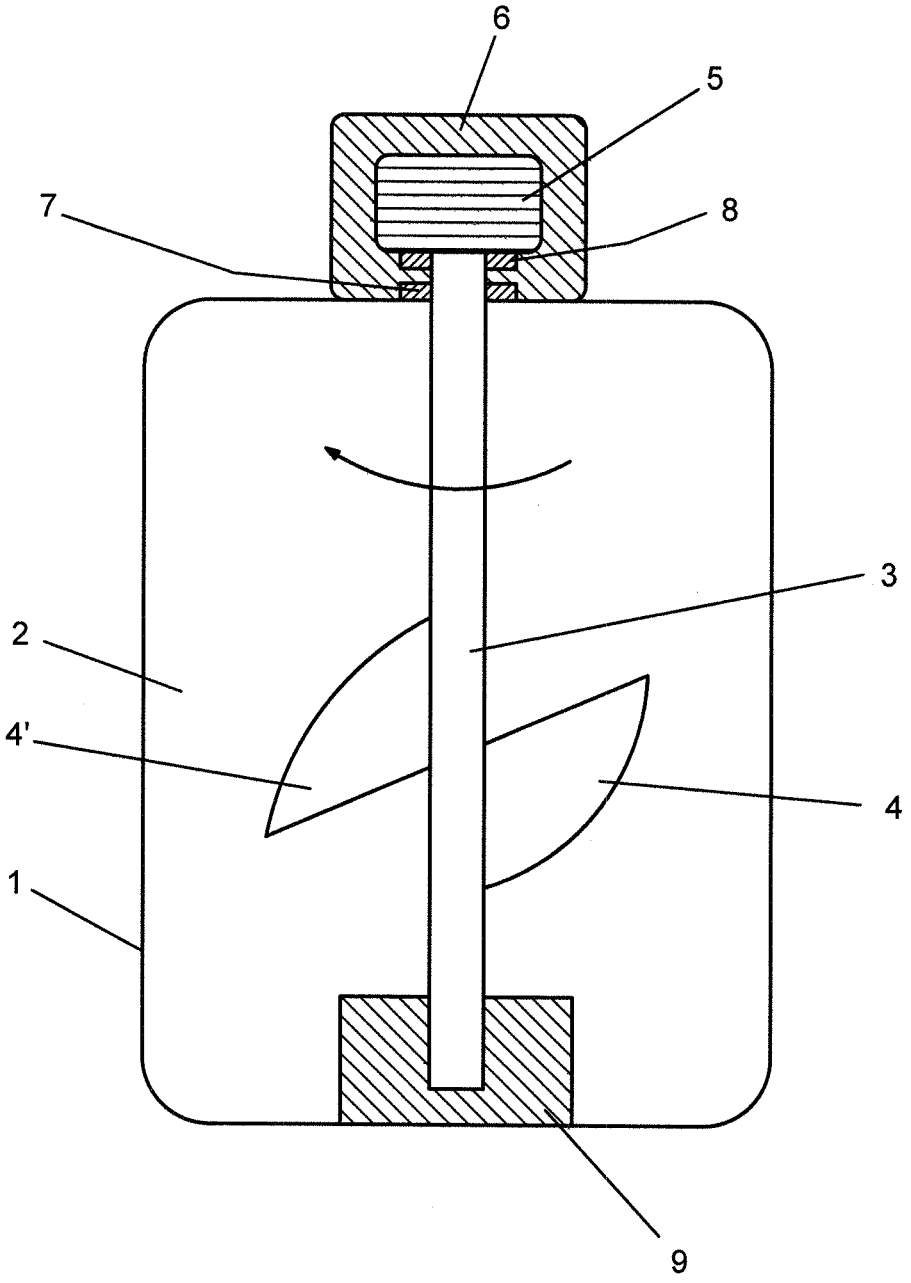
FIG. 1 shows a schematic overview over a mixing system with a drive for single use, in which the drive is situated outside of the single-use container.

In accordance with FIG. 1, the mixing system consists of a single-use container 1, which has a container interior 2. In the container interior 2 there is a mixer shaft 3 with the mixing elements 4 and 4'. The mixer shaft 3 is set into a rotating motion by a drive 5 that is situated outside of the container interior 2. The drive is surrounded by an encapsulation 6 made of plastic. In order to prevent media from the container interior 2 from penetrating said encapsulation, the opening thereof to the container interior 2 is provided with a seal 7 that encompasses the mixer shaft 3. Two bearings are used to accommodate the mixer shaft 3, of which a first bearing 8 is connected to the encapsulation 6 and a second bearing 9 is situated on the base of the single-use container 1.

Figure 2:
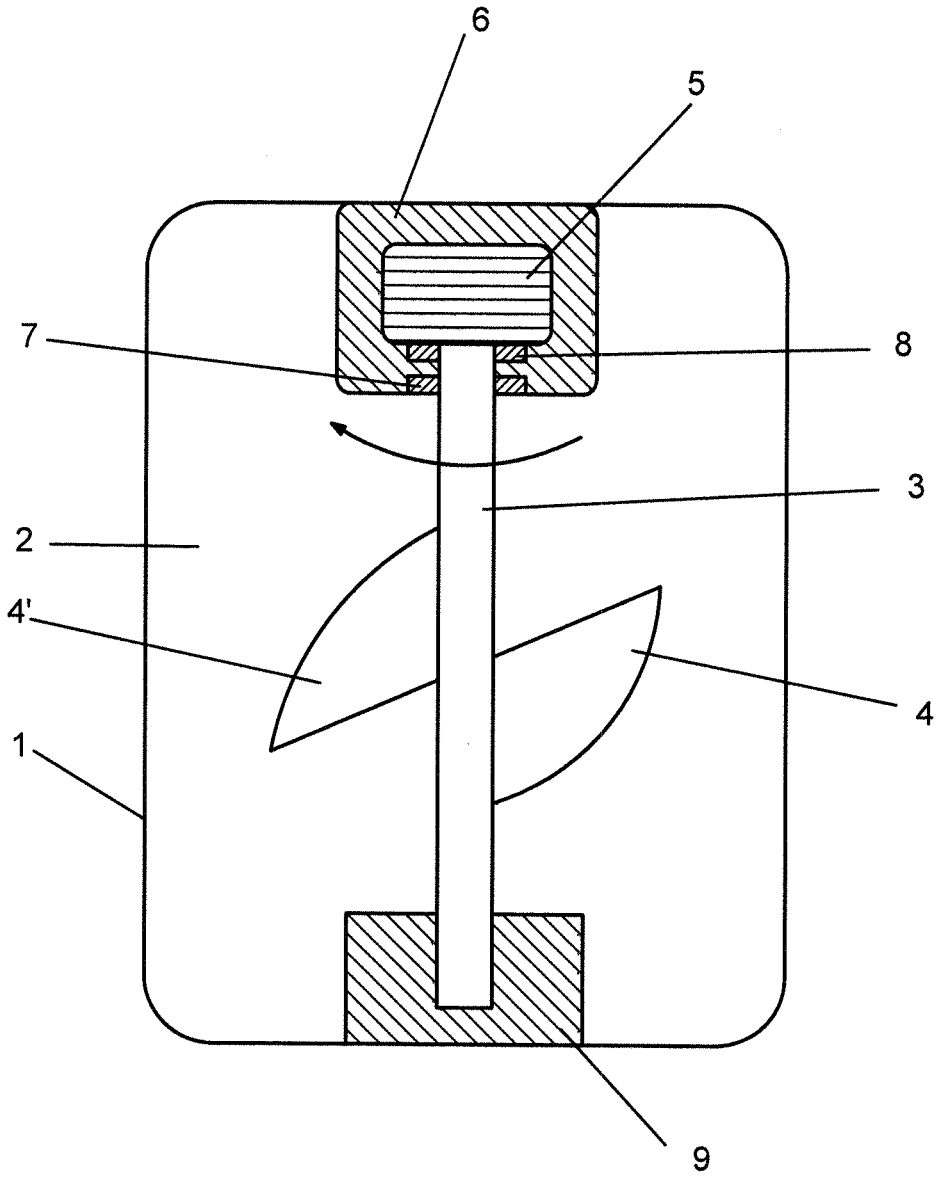
FIG. 2 shows a schematic overview over a mixing system with a drive for single use, in which a rotating drive is situated within the container interior.

In accordance with FIG. 2, the mixing system consists of a single-use container 1, which has a container interior 2. In the container interior 2 there is a mixer shaft 3 with the mixing elements 4 and 4'. The mixer shaft 3 is set into a rotating motion by a drive 5 that is situated within the container interior 2. The drive is surrounded by an encapsulation 6 made of plastic. In order to prevent media from the container interior 2 from penetrating said encapsulation, the opening thereof to the container interior 2 is provided with a seal 7 that encompasses the mixer shaft 3. Two bearings are used to accommodate the mixer shaft 3, of which a first bearing 8 is connected to the encapsulation 6 and a second bearing 9 is situated on the base of the single-use container.

Figure 3:
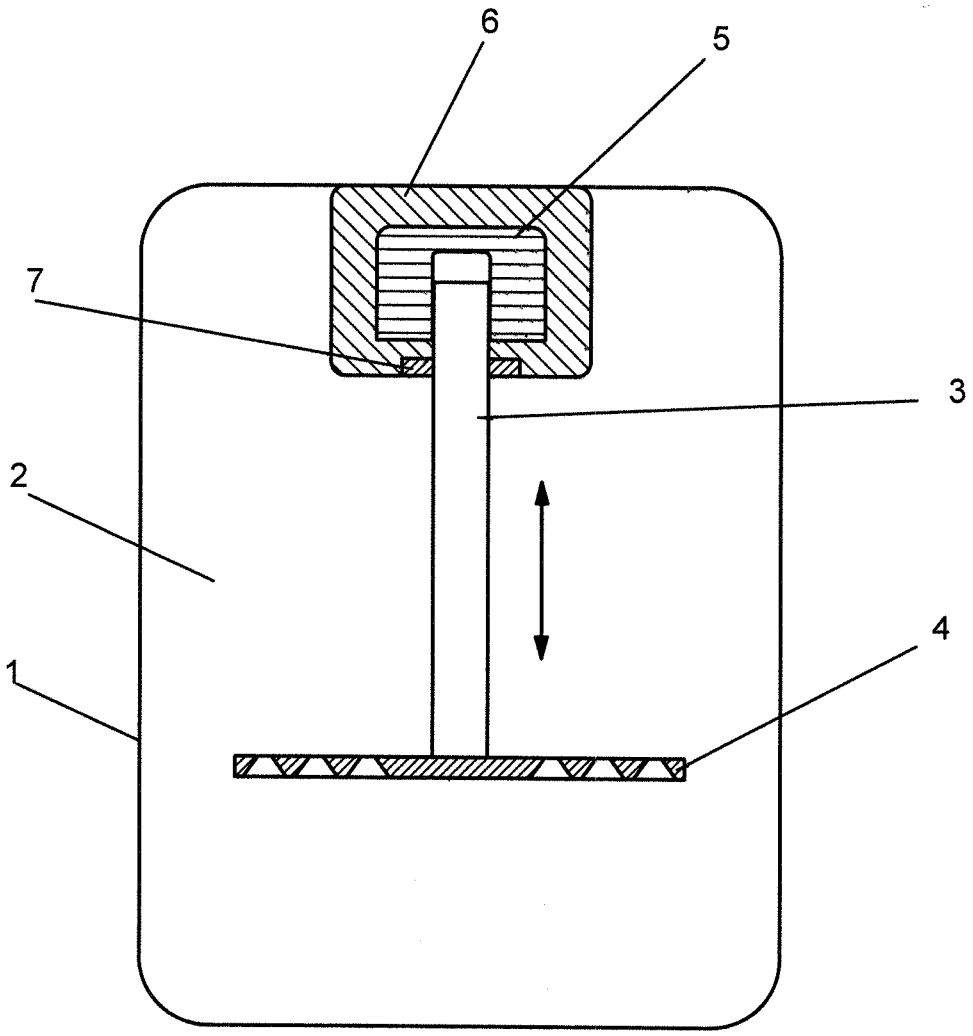
FIG. 3 shows a schematic overview over a mixing system with a drive for single use, in which a linear drive is situated within the container interior.

According to FIG. 3, the mixing system consists of a single-use container 1, which has a container interior 2. In the container interior there is a mixer shaft 3 with a mixing element 4. The mixer shaft 3 is set into a linear up and down motion by a drive 5 that is situated within the container interior. The drive is surrounded by an encapsulation 6 made of plastic. In order to prevent media from the container interior 2 from penetrating said encapsulation, the opening thereof to the container interior 2 is provided with a lip seal 7 that encompasses the mixer shaft 3, or additional flexible bellows made of plastic are formed onto the encapsulation 6, the former confining a section of the mixer shaft below the encapsulation in a sealing fashion (not illustrated).

The invention claimed is:

1. A mixing system, comprising a single-use container (1) with flexible walls defining an interior (2) and a mixing device, the mixing device having at least one drive (5) and a mixer shaft (3), the drive (5) being encapsulated and embedded in a capsule (6) made of a plastic material so that the drive is surrounded by the plastic material of the capsule (6), the capsule (6) having an opening that opens toward the interior (2) of the container (1), a seal (7) in the capsule (6) in proximity to the opening and surrounding the mixer shaft (3), wherein the drive (5) can be disposed of after use together with the mixer shaft (3) and the single-use container (1).

2. The mixing system of claim 1, wherein the drive (5) is situated in the container interior (2).

3. The mixing system of claim 1, wherein the drive (5) is situated outside of the container interior (2).

4. The mixing system of claim 3, wherein the drive (5) is configured to set the mixer shaft (3) into rotation.

5. The mixing system of claim 3, wherein the drive (5) is confioured to set the mixer shaft (3) into linear up and down motion.

6. The mixing system of claim 4, wherein the drive (5) can be driven by electrical, pneumatic or hydraulic power.

7. The mixing system of claim 1, in which the drive (5) is sterilized.

8. The mixing system of claim 2, wherein the drive (5) is configured to set the mixer shaft (3) into rotation.

9. The mixing system of claim 2, wherein the drive is configured to set the mixer shaft (3) into linear up and down motion.

* * * * *